US007066534B2

(12) United States Patent
Choi

(10) Patent No.: US 7,066,534 B2
(45) Date of Patent: Jun. 27, 2006

(54) HARD ARM CHAIR WITH SLIDING ARM MECHANISMS

(75) Inventor: Harrison Choi, Fujian (CN)

(73) Assignee: North Pole Limited, Kowloon (HK)

( * ) Notice: Subject to any disclaimer, the term of this patent is extended or adjusted under 35 U.S.C. 154(b) by 0 days.

(21) Appl. No.: 10/216,032

(22) Filed: Aug. 9, 2002

(65) Prior Publication Data

US 2003/0030305 A1 Feb. 13, 2003

Related U.S. Application Data

(60) Provisional application No. 60/311,306, filed on Aug. 10, 2001, provisional application No. 60/311,467, filed on Aug. 10, 2001.

(51) Int. Cl.
*A47C 4/48* (2006.01)

(52) U.S. Cl. ..... 297/16.2; 297/38

(58) Field of Classification Search ..... 297/16.2, 297/35, 38, 39, 41, 45
See application file for complete search history.

(56) References Cited

U.S. PATENT DOCUMENTS

| | | | | | |
|---|---|---|---|---|---|
| 2,009,918 | A | * | 7/1935 | Grassi | 297/38 |
| 2,195,461 | A | * | 4/1940 | Koenig | 297/31 |
| 2,571,463 | A | * | 10/1951 | Lorenz | 297/29 |
| 3,709,554 | A | * | 1/1973 | Feher | 297/26 |
| 3,972,562 | A | | 8/1976 | Montrose | |
| 4,325,577 | A | | 4/1982 | Thebaud | |
| 4,437,700 | A | | 3/1984 | Elaschuk | |
| 4,529,245 | A | | 7/1985 | Kassai | |
| 4,536,026 | A | | 8/1985 | Cornell | |
| 4,613,185 | A | | 9/1986 | Marchesini | |
| 4,645,260 | A | | 2/1987 | Harty et al. | |
| 4,674,793 | A | | 6/1987 | Kettler | |
| 4,693,510 | A | | 9/1987 | Marchesini | |
| 4,715,650 | A | * | 12/1987 | Berman et al. | 297/28 |
| 5,542,739 | A | | 8/1996 | Hultman | |
| 5,584,529 | A | | 12/1996 | Cheng | |
| 5,653,502 | A | | 8/1997 | Kimura et al. | |
| 5,735,570 | A | | 4/1998 | Tseng | |
| 5,829,837 | A | | 11/1998 | Reiersen | |
| 5,855,409 | A | | 1/1999 | Tseng | |
| 5,893,605 | A | | 4/1999 | Chang | |
| 5,899,525 | A | | 5/1999 | Tseng | |
| 5,947,553 | A | | 9/1999 | Tseng | |
| 5,984,406 | A | | 11/1999 | Lee | |
| 6,082,813 | A | | 7/2000 | Chen | |
| 6,217,111 | B1 | | 4/2001 | Tseng | |
| 6,247,750 | B1 | * | 6/2001 | Tsai | 297/16.2 |
| 6,364,409 | B1 | | 4/2002 | Saul et al. | |
| 6,406,091 | B1 | | 6/2002 | Saul et al. | |
| 6,454,348 | B1 | * | 9/2002 | Wu | 297/16.2 |

* cited by examiner

*Primary Examiner*—Peter R. Brown
(74) *Attorney, Agent, or Firm*—Armstrong Teasdale LLP

(57) ABSTRACT

A collapsible chair (10), having a frame assembly (16) including a number of frame members (20), the upper ends of the frame members (20) being pivotally attached to upper pivot assemblies (36, 38), and the lower ends being pivotally attached to lower pivot assemblies (30, 32). The frame members (20) are connected such that the frame assembly (16) as a whole expands outwardly from a central area (40) when the chair (10) is unfolded. The frame assembly (16) further including rear members (28) and front support members (50), and a pair of rigid arm rest members (46, 146). A pair of pivot mechanisms (70) and a pair of slide-pivot mechanisms (72) attach the rigid arm rest members (46, 146) to the frame assembly (16) such that the rigid arm members (46, 146) are allowed to slide and pivot as the chair (10) collapses or expands.

22 Claims, 10 Drawing Sheets

HARD ARM CHAIR WITH SLIDING ARM MECHANISMS

This application claims priority from U.S. Provisional Applications Ser. Nos. 60/311,306, filed Aug. 10, 2001, and 60/311,467, filed Aug. 10, 2001.

TECHNICAL FIELD

The present invention relates generally to recreational furniture and particularly to collapsible chairs.

BACKGROUND ART

Collapsible chairs are designed with the twin goals of comfort and ease of storage. They are generally collapsed for storage when not in use, so the smaller and more compact the chair can be in its collapsed state, the better it is generally perceived to be by the user. When in use, however, a larger configuration is often desirable, and arm rests are a positive addition to comfort. Some collapsible chairs have used material stretched between frame members to provide arm rests, while others use hard arm members of rigid material such as wood or plastic to provide solid arm rests. These solid arm rests may be perceived as more substantial by users. In particular, when a user raises himself from the chair, it may be more comfortable to have a solid member to push against than a flexible one, when gaining one's footing.

Hard arm folding chairs have been in use for many years. The traditional lawn chair, typically made of aluminum, usually had hard arms, and folded into a flat package by the use of hinges which allowed the frame to move from a rectangular cross-section to a trapezoidal one with the top and bottom edges finally meeting. Variations on this type of chair can be seen in numerous U.S. patents, including U.S. Pat. Nos. 4,536,026, 4,437,700, 4,613,185, 5,855,409, and 6,217,111, to name but a few. These chairs fold in only one direction, either front to back, or side to side. If one were to look at the movement of four feet alone from an overhead perspective, either the front two feet and the rear two feet would approach each other, or the two left side feet would approach the right side feet.

Collapsible chairs have become increasing sophisticated, with a new style that has become increasing popular in recent years. In this style, the chair frame may be made of a number of crossed members making a series of "X"s. When this style of chair is collapsed, the feet move in 2 dimensions toward a central point or area, so that they all move toward each other. This allows the chair to collapse into a compact bundle which is more like an umbrella than the flat package seen in the older style chairs. This style of chair is seen in U.S. Pat. Nos. 5,984,406, and 5,893,605. The difficulty with this type of chair, which will be referred to as an "X-frame chair" is that hard arms are usually attached at 2 points with a swivel or hinge joint. This works well with a chair which collapses in one direction, so that as the left side feet approach the right side feet, the hard arm can move in parallel towards the hard arm on the other side. However, in an X-frame chair, the chair collapses in two directions so that the front left foot approaches the left rear foot at the same time that it approaches the right front foot. A hard arm that is attached by hinge joints at the ends must collapse in length as the hinge joint point move closer to each other. For this reason, the chairs in the two patents referred to above have flexible cloth arms rather than hard arms.

U.S. Pat. No. 6,082,813 discloses an X-frame chair with hard arms, and deals with the problem by having the arms detach at their forward ends from the frame. This however has the disadvantage of leaving the arm members to dangle when the chair is collapsed, so that the members may run into other objects, possibly damaging the members or the other objects. In addition the rear joint may become stressed and break, and there is a small amount of assembly required, which is less desirable than a construction that requires no assembly at all.

Thus there is a need for an X-frame style chair which includes hard arms which are permanently attached, require no assembly, and collapses without detaching the arms in any way.

DISCLOSURE OF INVENTION

Accordingly, it is an object of the present invention to provide a portable chair which collapses easily to a compact configuration.

Another object of the invention is to provide a chair which has an improved upper arm width.

And another object of the invention is to provide a chair which expands or contracts as a unit, and thus requires very little manual manipulation.

A further object of the present invention is to provide a chair which has improved stability and sturdiness.

An additional object is to provide a folding chair with X-frame construction, which can still use hard arm rests.

Briefly, one preferred embodiment of the present invention is a collapsible chair, having a frame assembly including a number of frame members, the upper ends of the frame members being pivotally attached to upper pivot assemblies, and the lower ends being pivotally attached to lower pivot assemblies. The frame members are connected such that the frame assembly as a whole expands outwardly from a central area. The frame assembly further including rear members and front support members, and a pair of rigid arm rest members. A pair of pivot mechanisms and a pair of slide-pivot mechanisms attach the rigid arm rest members to the frame assembly such that the rigid arm members are allowed to slide and pivot as the chair collapses or expands.

An advantage of the present invention is that its structure is very sturdy and stable.

Another advantage of the present invention is that the arm separation is improved so that the seat feels less cramped.

And another advantage of the present invention is that the arms pivot to a vertical orientation, so that the "footprint" of the chair is very compact.

A further advantage of the present invention is that the frame moves as a unit to expand or contract from a central point.

An additional advantage is that the hard arm rests are mounted in slide-pivot housings which allow the arm to slide and pivot to vertical position as the chair collapses.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
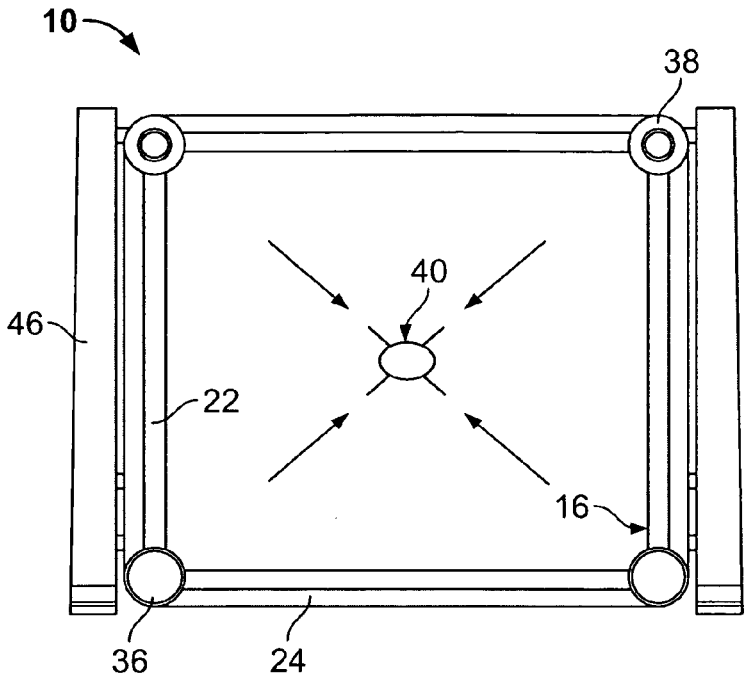
FIG. 1 shows a top plan view of the frame of the chair of the present invention which is in expanded configuration.

A preferred embodiment of the present invention is a folding glider chair. As illustrated in the various drawings herein, and particularly in the view of FIG. 1, a form of this preferred embodiment of the inventive device is depicted by the general reference character 10.

FIGS. 1–13 show a first embodiment of the present invention which uses a tubular slide-pivot mechanism.

Figure 2:
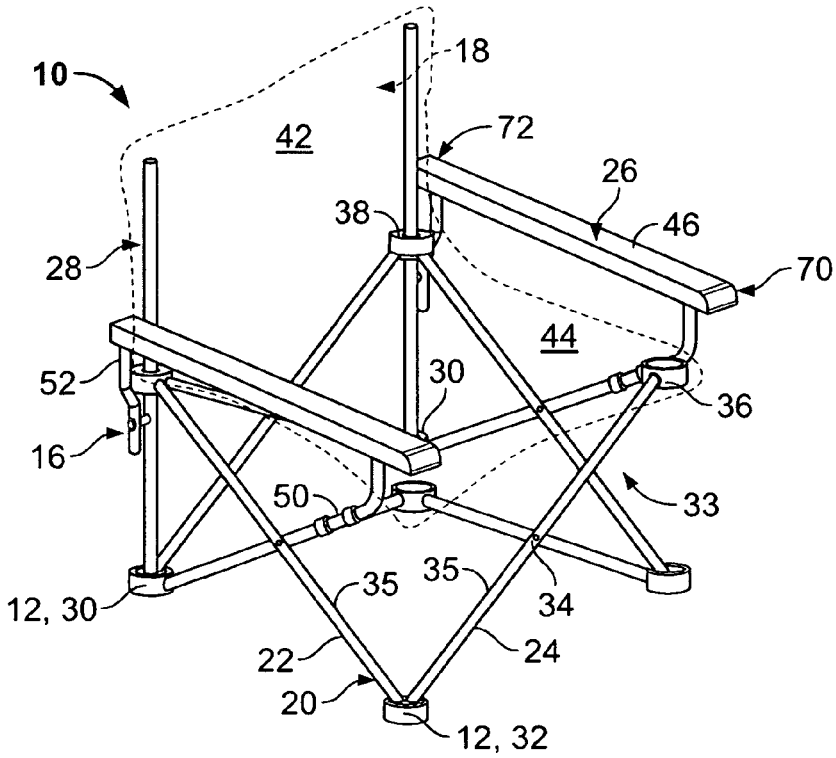
FIG. 2 shows a top isometric view of the frame of the chair of the present invention which is in expanded configuration.
Figure 3:
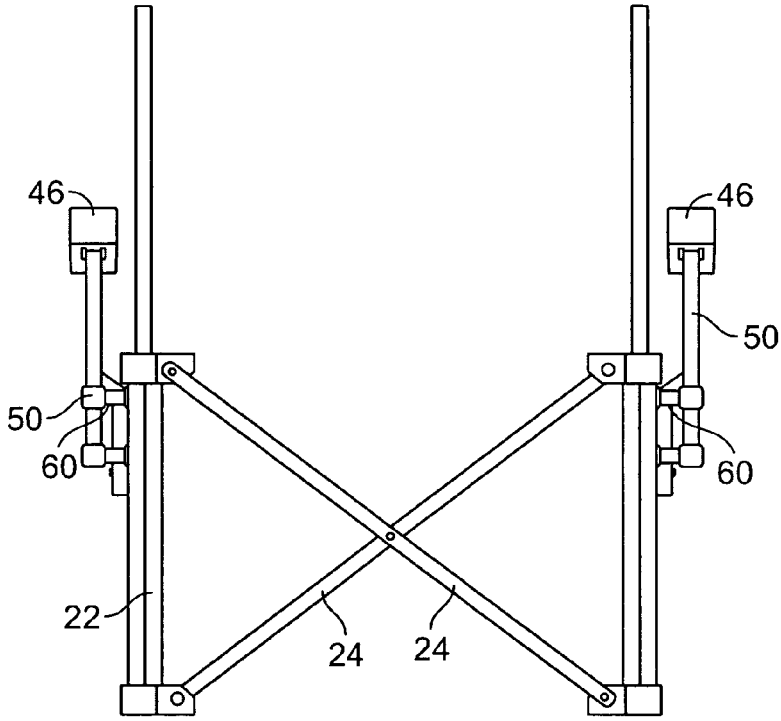
FIG. 3 shows a front plan view of the frame of the chair of the present invention which is in expanded configuration.
Figure 4:
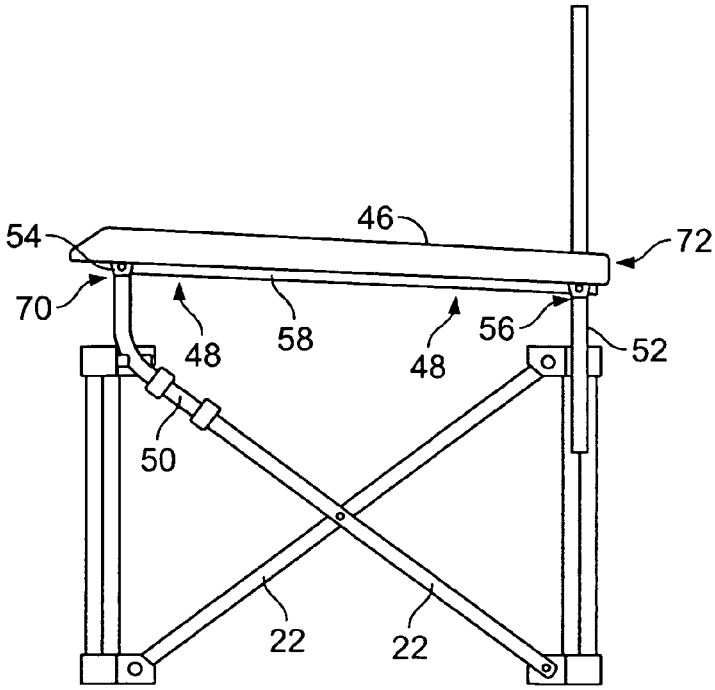
FIG. 4 shows a side plan view of the frame of the chair of the present invention which is in expanded configuration.
Figure 5:
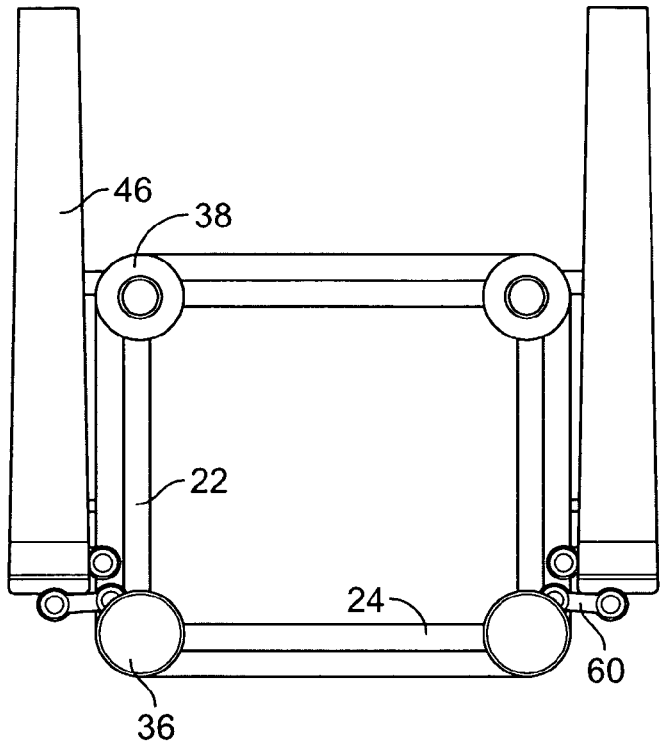
FIG. 5 shows a top plan view of the frame of the chair of the present invention which is in partially contracted configuration.
Figure 6:
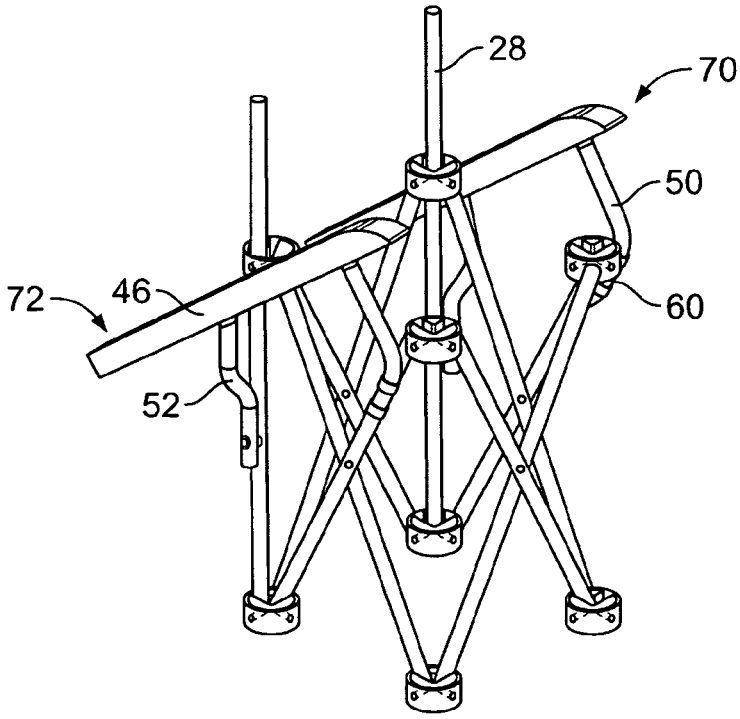
FIG. 6 shows a top isometric view of the frame of the chair of the present invention which is in partially contracted configuration.
Figure 7:
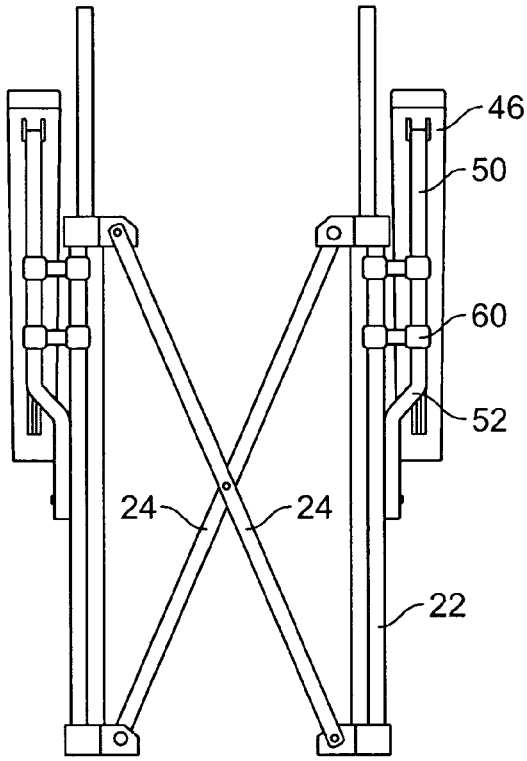
FIG. 7 shows a front plan view of the frame of the chair of the present invention which is in partially contracted configuration.
Figure 8:
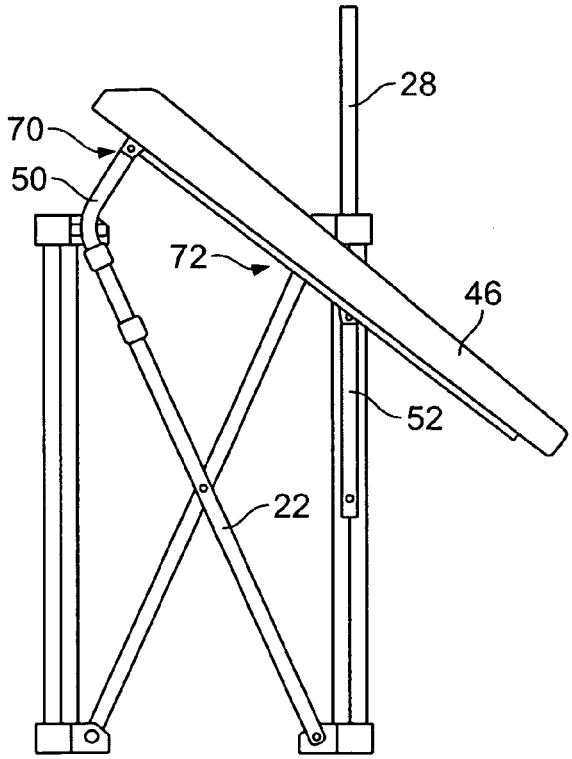
FIG. 8 shows a side plan view of the frame of the chair of the present invention which is in partially contracted configuration.
Figure 9:
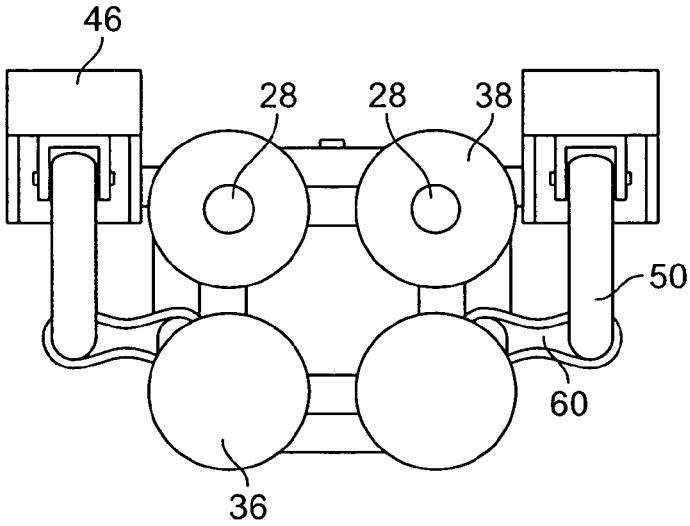
FIG. 9 shows a top plan view of the frame of the chair of the present invention which is in fully contracted configuration.
Figure 10:
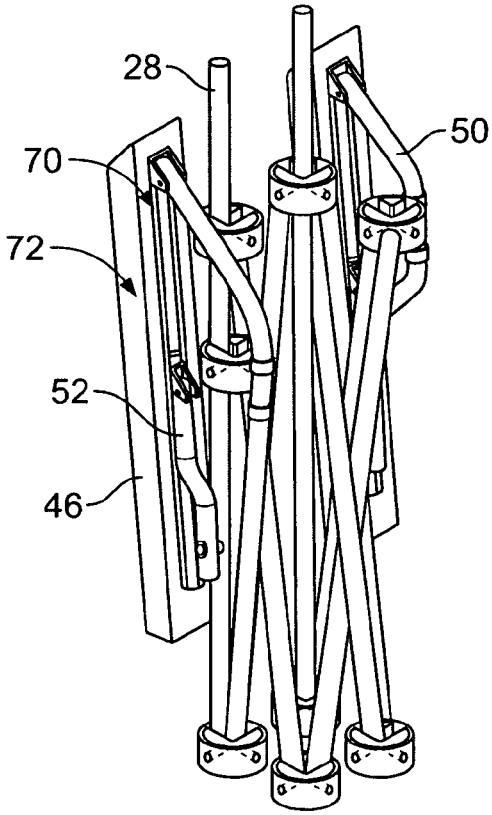
FIG. 10 shows a top perspective view of the frame of the chair of the present invention which is in fully contracted configuration.
Figure 11:
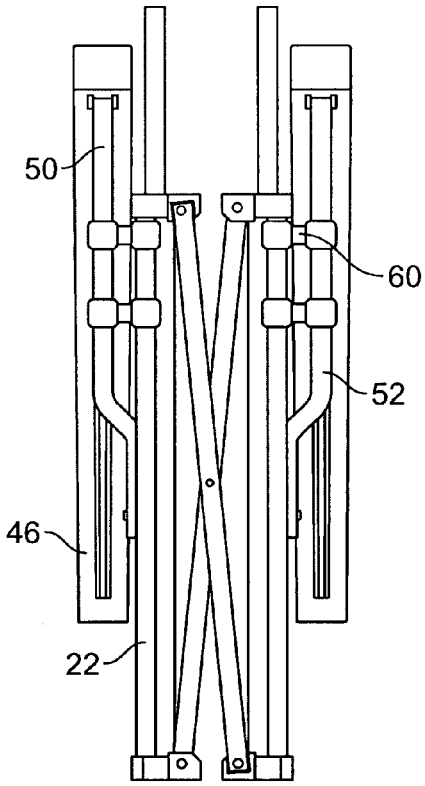
FIG. 11 shows a front plan view of the frame of the chair of the present invention which is in fully contracted configuration.
Figure 12:
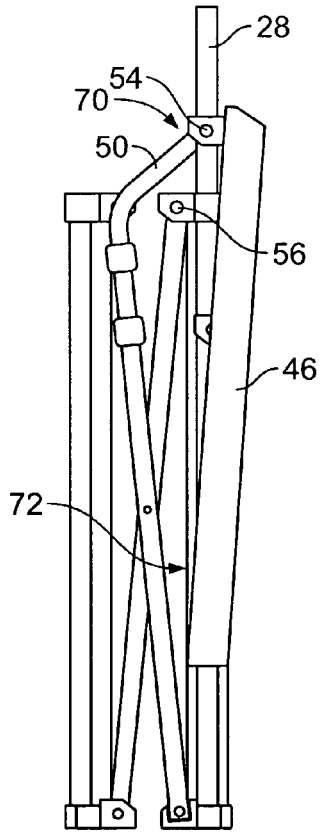
FIG. 12 shows a side plan view of the frame of the chair of the present invention which is in fully contracted configuration.

FIGS. 1–4 illustrate a folding chair 10 in expanded configuration, which includes generally a chair frame assembly 16 and a fabric covering 18, shown in dashed line in FIG. 2, to allow easier viewing of the frame 16. The chair frame assembly 16 includes a number of frame members 20 including side members 22, front members 24, and having arm support assemblies 26. The frame 16 also includes rear members 28 which extend generally vertically upwards from rear pivot assemblies 30, and protrude through rear upper pivot assemblies 38. The front members 24 and side members 22 are joined at the front lower pivot assemblies 32, and front upper pivot assemblies 36. The rear lower pivot assemblies 30, front lower pivot assemblies 32, rear upper pivot assemblies 38, front upper pivot assemblies 36, and approximate midpoints of the members 20, all include pivots 34. The rear lower pivot assemblies 30, and front lower pivot assemblies 32 also serve as feet 12 for the chair 10.

These pivot assemblies 30, 32, 36, 38 and pivots 34 connect all the frame members 20 to each other, so there are no loose pieces to be gathered and assembled. The frame 16 can be thought of as an X-frame or an extended scissors-frame assembly 33 since the tops and bottoms of each pair of frame members 20 scissor together or apart. These scissor pairs 35 are then joined in an extended assembly where the ends of multiple pairs 35 are joined at the pivot assemblies 30, 32, 36, 38. They also allow the frame 16 as a whole to be collapsed or expanded in a very easy and efficient manner. Force directed at any one of the corners causes movement in all the other corners, so that there is movement of the whole frame in either an inward or outward direction, relative to a central area. The pivots 34 allow the frame structure 16 to move towards a central area 40 from all sides as a unit when the frame 18 is to be collapsed, and to move away from this central area 40 when expanding. Moreover, the chair frame assembly 16 tends to move as a unit towards a collapsing or expanding configuration, so that force exerted on one corner of the frame to collapse the frame will act to move the other corners as well towards a central point 40. The expansion or collapsing of the chair 10 is thus very quickly and easily accomplished.

This configuration will be spoken of as "expanding outwardly from a central area", although it is to be understood that one of the feet may actually remain in fixed position, while the remainder of the feet move outward. In other words, the central reference area from which the feet move, may itself move laterally. One example of this occurs when the collapsed support frame is placed in the corner of a room, where, say, the left rear foot of the frame is in the left rear corner of the room, and thus is constrained from movement in a further leftward or rearward direction. When the frame expands, all the other, non-constrained feet will expand outwardly from a central area to the right, or forward, or both, even as the central area itself will move to the right and forward, relative to the immobile left rear foot.

It should also be understood that all the lines of direction of the movement of the feet are not expected to intersect at a precise point. The central area 40 is thus a relatively small region from which the feet 12 move outwardly, but there should be no inference that all feet must move in a specific lines, such as radially from a single specific center point. To one skilled in the art, it will be apparent that if such precise directionality were attempted, manufacturing errors would inevitably introduce variations. Thus, the expansion is considered to move outwardly from a central area or region, and should not be construed to imply any particular lines of direction, other than generally outward from this central area. The direction arrows and central area 40 shown in FIG. 1, and later in FIG. 14 below, are therefore not provided to show specific lines of movement which must be followed, but merely a general direction of movement towards, or away from, a general central area 40.

The fabric covering 18 generally includes a back portion 42, and a seat 44, which may be formed from a unitary cloth portion or may be separate pieces. It is preferred that the fabric covering 18 be also permanently attached at some point or points to the frame 16, so that pieces may not be lost, and assembly is facilitated.

Figure 13:
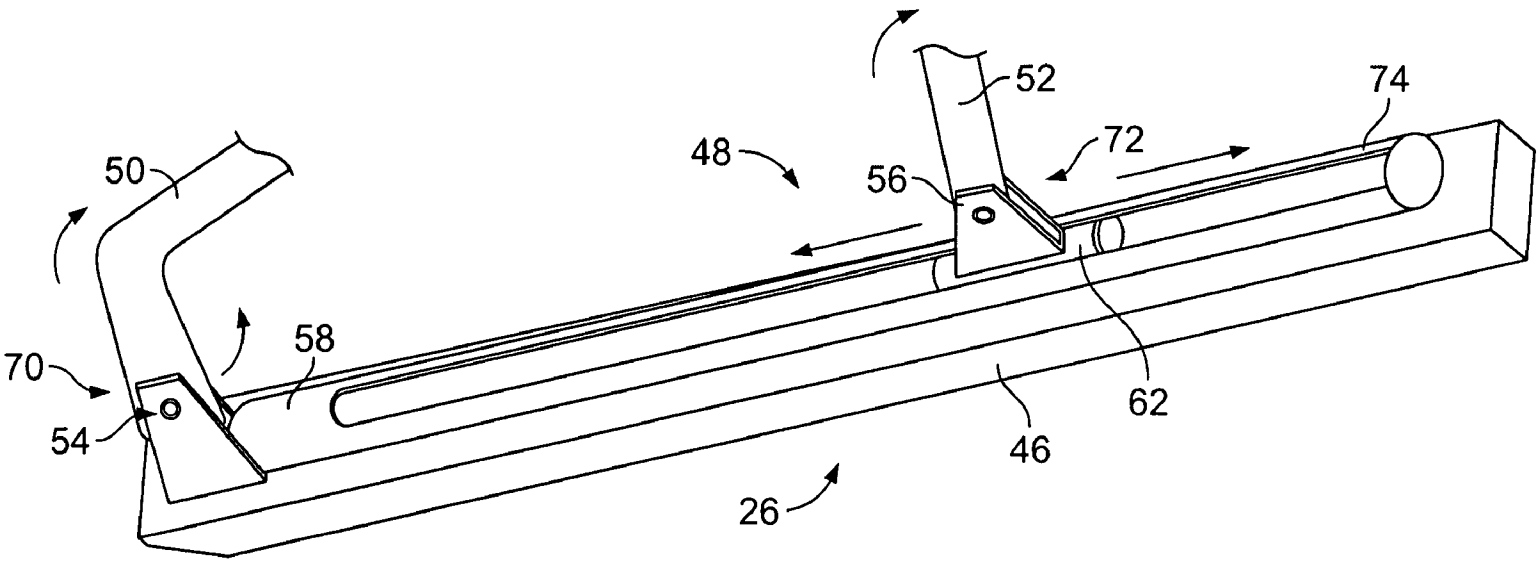
FIG. 13 shows a bottom isometric view of the arm rest and tubular sliding mechanism of the present invention.

Referring now also to FIG. 13 which is an underside detail view of the arm rests and sliding mechanisms, the arm support assemblies 26 include arm rests 46, which are attached to the frame 16 by tubular member sliding mechanisms 48. The frame 16 includes front members 50 and rear members 52 which are attached to the arm rests 46 at front pivotal members 54 and rear lower pivotal members 56. The front pivotal members 54 attach the front portions of the arm rests 46 to the front support members 50 and are thus preferably prevented from sliding, allowing only rotational movement as indicated by the arrows. The front support member 50 is then attached to the frame side member 22 by a coupling member 60, which is preferably mounted on the outer side of the chair frame assembly 16 (see FIG. 3). This allows for a wider "arm rest span" than is usual in collapsible chairs.

The upper ends of the rear support members 52 are attached to the rear lower pivotal members 56 which are then attached to tubular slide members 62. The rear support members 52 are attached to the rear lower pivotal members 56 and the rear frame members 28 by fasteners such as rivets. Preferably the rear support members 52 are curved outward from the side members 22, or alternatively, coupling members may again act as stand-offs, so that the arm separation is again increased. It will be obvious that curved members may also be used in the front support members 50 in place of the coupling members 60.

The slide members 62 are partially enclosed in tubular enclosures 58 which are in turn fixed to the arm rests 46. These slide members 62 are allowed to slip back and forth in these enclosures 58 as indicated by the direction arrows, as the mechanism 48 rotates. Thus, the sliding mechanism 48 functions so that as the feet are drawn together while the frame 16 collapses, the arm rests 46 will pivot further and further towards vertical (see FIGS. 5–8), until when fully collapsed (see FIGS. 9–12), the rear end of the arm rests 46 are fully extended and the arm rests 46 are substantially vertical. The chair 10 thus assumes a very compact "footprint" or horizontal area, since the long frame members, including the arm rests 46 are all nearly vertical and compactly bundled.

Thus, the frame 16 uses generally a pivot mechanism 70 in which the arm rest member 46 is allowed to pivot, but is restrained from lateral motion or sliding, and a slide-pivot mechanism 72, in which a tubular slide member 62 which is attached by a rear pivotal member 56 to the frame 16 is allowed to slide within a tubular enclosure 58. In this embodiment, the pivot mechanism 70 is a front pivotal member 54, and the slide-pivot mechanism 72 is a tubular member sliding mechanism 48 and rear pivotal member 56, but other variations are possible, as will be seen below. It will also be obvious to one skilled in the art that the slide-pivot mechanism 72 may be located in the front and the pivot mechanism 70 may be located in the rear.

The arm rests 46 are shown as molded plastic forms which are generally flat on top, but this is not to be construed as a limitation, as they may also be entirely or partially curved. It is also possible that the slide members and tubular enclosures not be configured as with a circular cross-section, but may instead be tubes, or rods of any regular or irregular cross-sectional shape. There may also be locating or retaining notches included which may help to maintain the chair in expanded or partially expanded configuration, or alternatively, may help to hold it in a bundled configuration. Also, although the arm rests are generally referred to as being "rigid" this term is meant to include materials that have some flexibility such as plastics, etc, but are not as flimsy as cloth.

A second embodiment of the present invention is illustrated in FIGS. 14–19. This alternate embodiment will be designated by the reference number 100. Where elements are similar to those described with reference to the first embodiment, the same reference numbers will be used. Elements which are peculiar to the second embodiment will generally be referred to by a three digit reference number prefaced by a "1".

Figure 14:
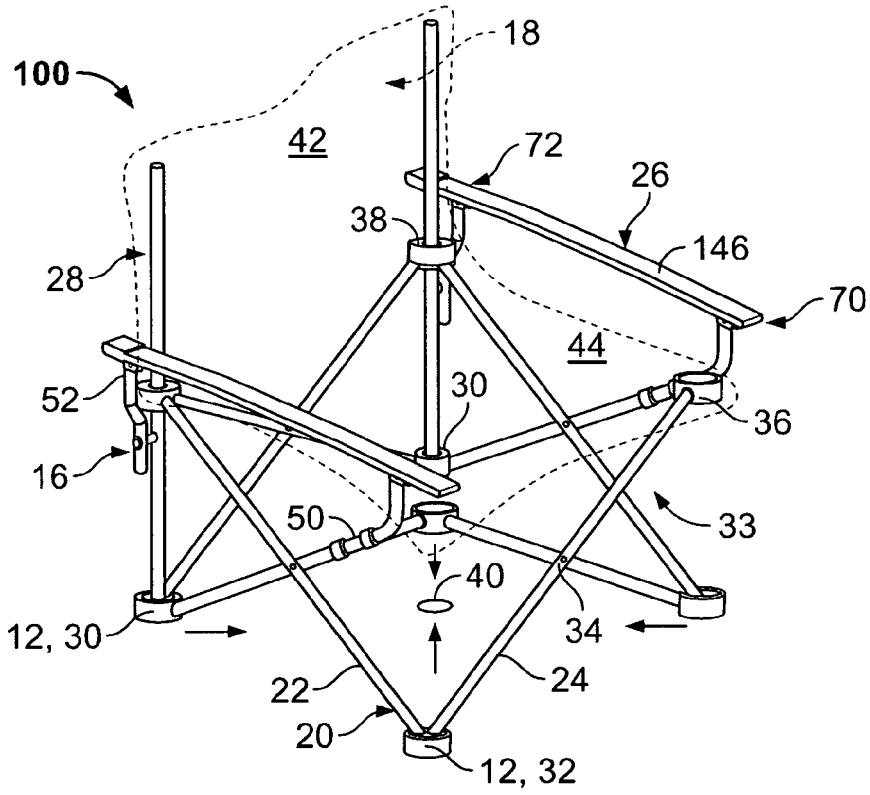
FIG. 14 shows a top isometric view of an alternative embodiment of the frame of the chair of the present invention which is in expanded configuration.
Figure 15:
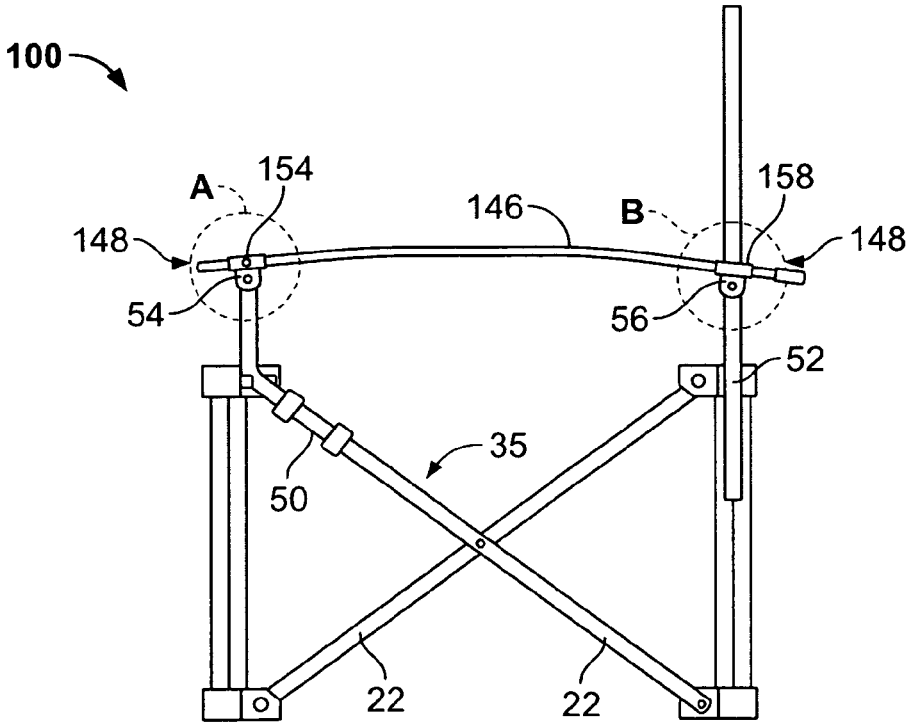
FIG. 15 shows a side plan view of an alternative embodiment of the frame of the chair of the present invention which is in expanded configuration.
Figure 16:
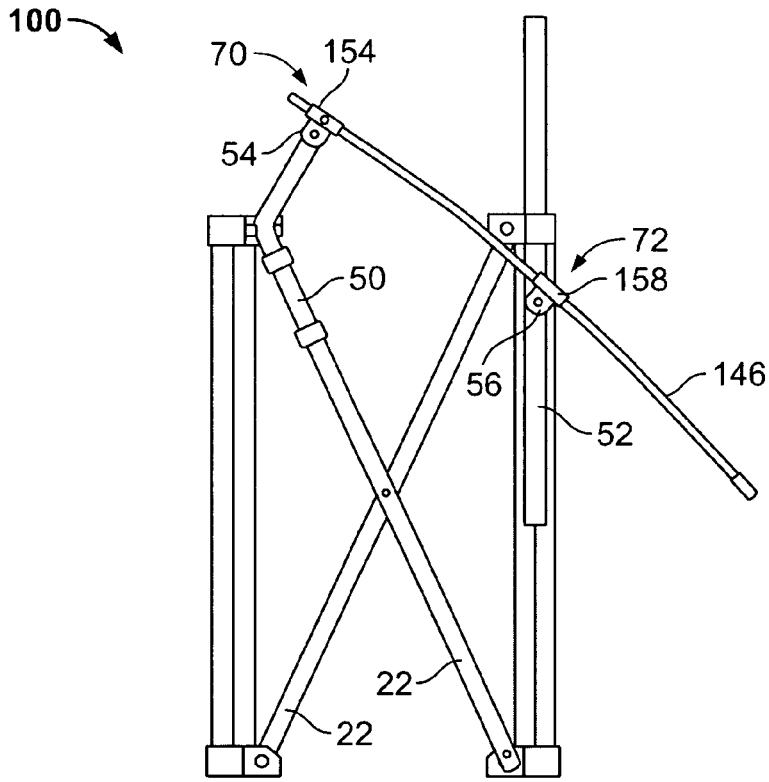
FIG. 16 shows a side plan view of an alternative embodiment of the frame of the chair of the present invention which is in partially contracted configuration.
Figure 17:
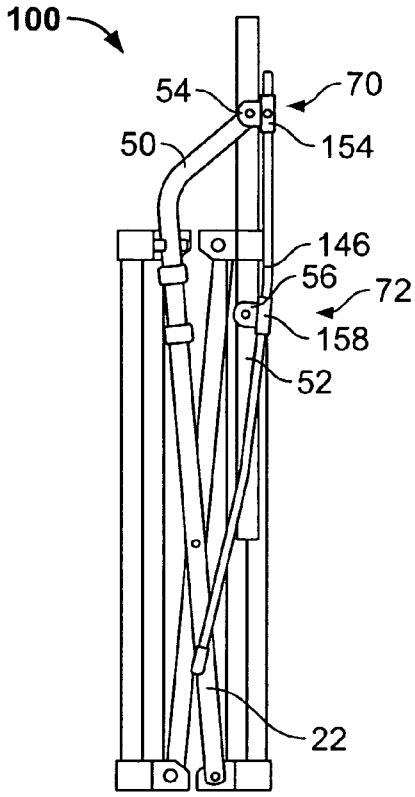
FIG. 17 shows a side plan view of an alternative embodiment of the frame of the chair of the present invention which is in fully contracted configuration.

FIGS. 14–15 illustrate a folding chair 100 in expanded configuration, which includes generally a chair frame assembly 16 and a fabric covering 18, shown in dashed line in FIG. 14, to allow easier viewing of the frame 16. The chair frame assembly 16 includes a number of frame members 20 including side members 22, front members 24, and having arm support assemblies 26. The frame 16 also includes rear members 28 which extend generally vertically upwards from rear lower pivot assemblies 30, and protrude through rear upper pivot assemblies 38. The front members 24 and side members 22 are joined at the front lower pivot assemblies 32, and front upper pivot assemblies 36. The rear lower pivot assemblies 30, front lower pivot assemblies 32, rear upper pivot assemblies 38, front upper pivot assemblies 36, and approximate midpoints of the members 20, all include pivots 34. The members 20 are thus permanently joined pivotally together so that there are no loose members that must be located and assembled. Moreover, the chair frame assembly 16 tends to move as a unit towards a collapsing or expanding configuration, so that force exerted on one corner of the frame to collapse the frame will act to move the other corners as well towards a central point 40. The assembly or disassembly of the chair 100 is thus very quickly and easily accomplished.

The rear lower pivot assemblies 30, and front lower pivot assemblies 32 also serve as feet 12 for the chair 100.

The fabric covering 18 generally includes a back portion 42, and a seat 44, which may be formed from a unitary cloth portion or may be separate pieces. It is preferred that the fabric covering 18 be also permanently attached at some point or points to the frame 16, so that pieces may not be lost, and assembly is facilitated.

Figure 18:
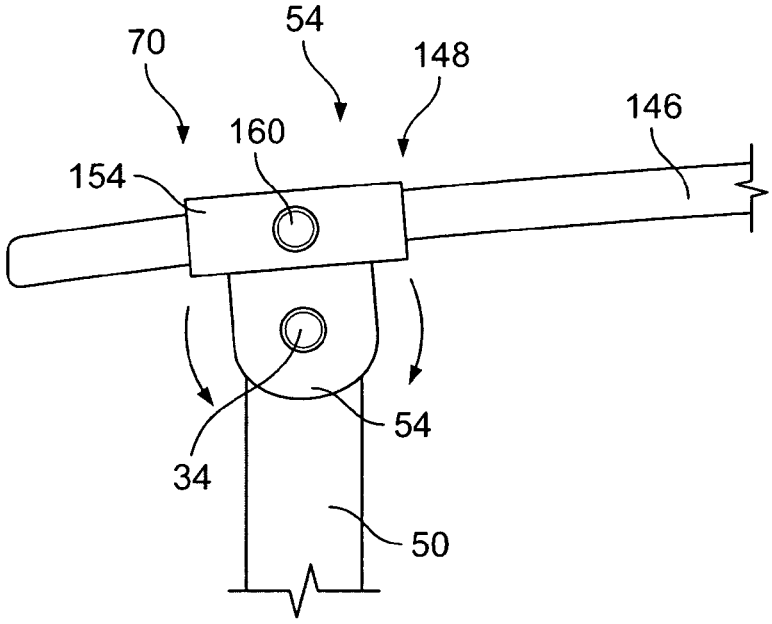
FIG. 18 shows a side plan view of the slide mechanism of the chair of the present invention, as seen in detail circle A of FIG. 15.
Figure 19:
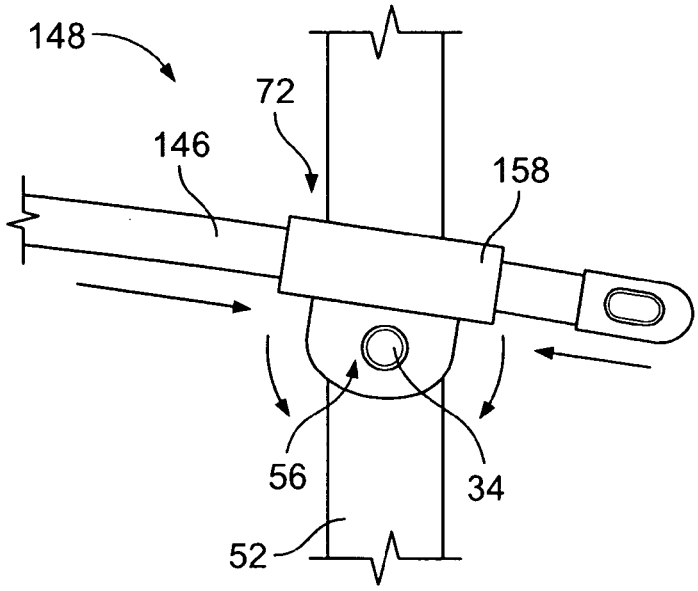
FIG. 19 shows a side plan view of the slide mechanism of the chair of the present invention, as seen in detail circle B of FIG. 15.

Referring now also to FIGS. 18 and 19 which are detail view of the detail circles A and B in FIG. 15, the arm support assemblies 26 include arm rests 146, which are attached to the frame 16 by flat member sliding mechanisms 148. The frame 16 includes front members 50 and rear members 52 which are attached to pivot enclosure 154 and slide enclosures 158 at front pivotal members 54 and rear pivotal members 56, respectively. The flat member arm rests 146 pass through the pivot enclosures 154 and slide enclosures 158 and are preferably prevented from sliding within the pivot enclosures 154 by fasteners 160. The front member 50 is then attached to the frame side member 22 by a coupling member in the same manner as in the previous embodiment, which is preferably mounted on the outer side of the chair frame assembly 16. This allows for a wider "arm rest span" than is usual in collapsible chairs.

The rear end of the arm rest 146 slips through a slide enclosure 158 which is pivotally attached to the rear support member 52 by rear pivotal members 56. The rear support members 52 are attached to the rear frame members 28 by fasteners such as rivets. Preferably the rear support members 52 are curved outward from the side members 22, or alternatively, coupling members may again act as standoffs, so that the arm separation is again increased. It will be obvious that curved members may also be used in the front support members 50 in place of the coupling members.

The rear ends of the arm rests 146 are allowed to slip back and forth in the slide enclosures 158 as indicated by the direction arrows, as the mechanism rotates. Thus, the flat member sliding mechanism 148 functions so that as the feet are drawn together while the frame 16 collapses, the arm rests 146 will pivot further and further towards vertical (see FIG. 16), until when fully collapsed (see FIG. 17), the rear end of the arm rests 146 are fully extended and the arm rests 146 are substantially vertical. The chair 100 thus assumes a very compact "footprint" or horizontal area, since the long frame members, including the arm rests 146 are all nearly vertical and compactly bundled.

Thus, in this embodiment, the frame 16 again uses generally a pivot mechanism 70 in which the arm rest member 146 is allowed to pivot, but is restrained from lateral motion or sliding, and a slide-pivot mechanism 72, in which the arm rest member 146 is allowed to slide within a slide enclosure 158 which is attached by a rear pivotal member 56 to the frame 16. In this embodiment, the pivot mechanism 70 is a pivot enclosure 154, to which the flat arm rest member 146 is attached by a fastener 160, and the slide-pivot mechanism 72 is a combination of the slide enclosure 158 and rear pivotal member 56, but other variations are possible. As before, it will also be obvious to one skilled in the art that the slide-pivot mechanism 72 may be located in the front and the pivot mechanism 70 may be located in the rear as variations.

The arm rests 146 are shown as strips which are curved portions of ellipses, but this is not to be construed as a limitations as they may also be entirely or partially flat. It is also possible that the rests not be configured as strips, but may instead be tubes, or rods of any regular or irregular cross-section. There may also be locating or retaining notches included which may help to maintain the chair in expanded or partially expanded configuration, or alternatively, may help to hold it in a bundled configuration.

While various embodiments have been described above, it should be understood that they have been presented by way of example only, and not limitation.

INDUSTRIAL APPLICABILITY

The present collapsible chair 10 is expected to have many uses in recreational settings such as camping trips or for use in backyards, patios or even for indoor use. The present chair 10 uses hard arm members 46, 146 of rigid material to provide solid arm rests. These solid arm rests 46, 146 may be perceived as more substantial by users. In particular, when a user raises himself from the chair 10, it may be more comfortable to have a solid member to push against than a flexible one, when gaining one's footing.

In the present invention 10 pivot assemblies 30, 32, 36, 38 and pivots 34 connect all the frame members 20 to each other, so there are no loose pieces to be gathered and assembled. The frame 16 can be thought of as an X-frame or an extended scissors-frame assembly 33 since the tops and bottoms of each pair of frame members 20 scissor together or apart. These scissor pairs 35 are then joined in an extended assembly where the ends of multiple pairs 35 are joined at the pivot assemblies 30, 32, 36, 38. They also allow the frame 16 as a whole to be collapsed or expanded in a very easy and efficient manner. Force directed at any one of the corners causes movement in all the other corners, so that there is movement of the whole frame in either an inward or outward direction, relative to a central area. The pivots 34 allow the frame structure 16 to move towards a central area 40 from all sides as a unit when the frame 18 is to be collapsed, and to move away from this central area 40 when expanding. Moreover, the chair frame assembly 16 tends to move as a unit towards a collapsing or expanding configuration, so that force exerted on one corner of the frame to collapse the frame will act to move the other corners as well towards a central point 40. The expansion or collapsing of the chair 10 is thus very quickly and easily accomplished.

However, in an X-frame chair of this type, the chair collapses in two directions so that the front left foot approaches the left rear foot at the same time that it approaches the right front foot. A hard arm that is attached by hinge joints at the ends must collapse in length as the hinge joint point move closer to each other. For this reason, the arm rests must either shorten in length or be allowed to slide in some manner within the framework.

The slide members 62 are partially enclosed in a tubular enclosure 58 which are in turn fixed to the arm rests 46. These slide members 62 are allowed to slip back and forth in these enclosures 58, as the mechanism 48 rotates. Thus, the sliding mechanism 48 functions so that as the feet are drawn together while the frame 16 collapses, the arm rests 46 will pivot further and further towards vertical, until when fully collapsed, the rear end of the arm rests 46 are fully extended and the arm rests 46 are substantially vertical. The chair 10 thus assumes a very compact "footprint" or horizontal area, since the long frame members, including the arm rests 46 are all nearly vertical and compactly bundled.

Thus, the frame 16 uses generally a pivot mechanism 70 in which the arm rest member 46 is allowed to pivot, but is restrained from lateral motion or sliding, and a slide-pivot mechanism 72, in which a tubular slide member 62 which is attached by a rear pivotal member 56 to the frame 16 is allowed to slide within a tubular enclosure 58. In this embodiment, the pivot mechanism 70 is a front pivotal member 54, and the slide-pivot mechanism 72 is a tubular member sliding mechanism 48 and rear pivotal member 56.

In an alternate embodiment, the frame 16 again uses generally a pivot mechanism 70 in which the arm rest member 146 is allowed to pivot, but is again restrained from lateral motion or sliding, and a slide-pivot mechanism 72, in which the arm rest member 146 is allowed to slide within a slide housing 74 which is attached by a pivot 34 to the frame 16. In this embodiment, the pivot mechanism 70 is a pivot enclosure 154, to which the flat arm rest member 146 is attached by a fastener 160 and the slide-pivot mechanism 72 is a slide enclosure 158 and rear pivotal member 56.

For the above, and other, reasons, it is expected that the collapsible chair with rigid arm rests 10, 100 of the present invention will have widespread industrial applicability. Therefore, it is expected that the commercial utility of the present invention will be extensive and long lasting.

What is claimed is:

1. A collapsible chair comprising:

a frame assembly movable between a collapsed configuration and an expanded configuration, said frame assembly comprising:

a plurality of frame members, each frame member of said plurality of frame members including an upper end pivotally attached to a corresponding upper pivot assembly of a plurality of upper pivot assemblies, and a lower end pivotally attached to a corresponding lower pivot assembly of a plurality of lower pivot assemblies;

a rear frame member coupled to a rear lower pivot assembly of said lower pivot assemblies and extending through a rear upper pivot assembly of said upper pivot assemblies;

a rear support member coupled to said rear frame member;

a frame side member coupled between said rear lower pivot assembly and a front upper pivot assembly of said upper pivot assemblies; and a front support member coupled to said frame side member; and an arm support assembly pivotally coupled at a front portion to said front support member and pivotally coupled at a rear portion to said rear support member, said rear support member including a slide member positioned within an enclosure defined by said arm support assembly.

2. A collapsible chair in accordance with claim 1 further comprising a front pivotal member pivotally coupling said front portion to said front support member.

3. A collapsible chair in accordance with claim 1 further comprising a coupling member coupling said front support member with respect to a laterally outer side portion of said frame side member.

4. A collapsible chair in accordance with claim 1 further comprising a rear pivotal member pivotally coupling said rear support member and said slide member.

5. A collapsible chair in accordance with claim 1 wherein said rear support member curves laterally outwardly with respect to said frame side member.

6. A collapsible chair in accordance with claim 1 wherein said front support member curves laterally outwardly with respect to said frame side member.

7. A collapsible chair in accordance with claim 1 further comprising an arm rest coupled to said enclosure.

8. A collapsible chair in accordance with claim 1 wherein said slide member moves within said enclosure as said arm support assembly pivots with respect to said rear support member.

9. A collapsible chair in accordance with claim 1 wherein, with said frame assembly in the collapsed configuration, said arm support assembly is substantially parallel with said rear support member.

10. A collapsible chair in accordance with claim 1 wherein said plurality of frame members are coupled in a plurality of scissor pairs near respective midpoints, and ends of each frame member of said plurality of scissor pairs are joined at pivot assemblies to form said frame assembly, said frame assembly is movable towards a central area to the collapsed configuration and movable away from said central area to the expanded configuration.

11. A collapsible chair comprising:

a frame assembly movable between a collapsed configuration and an expanded configuration, said frame assembly comprising:

a plurality of frame members, each frame member of said plurality of frame members including an upper end pivotally attached to a corresponding upper pivot assembly of a plurality of upper pivot assemblies, and a lower end pivotally attached to a corresponding lower pivot assembly of a plurality of lower pivot assemblies;

a rear frame member coupled to a rear lower pivot assembly of said lower pivot assemblies and extending through a rear upper pivot assembly of said upper pivot assemblies;

a rear support member coupled to said rear frame member;

a frame side member coupled to said rear lower pivot assembly and a front upper pivot assembly of said upper pivot assemblies; and a front support member coupled to said frame side member; and an arm support assembly pivotally coupled at a front portion to said front support member and pivotally coupled at a rear portion to said rear support member, said rear support member including a slide member positioned within an enclosure defined by said arm support assembly, said slide member slidably movable within said enclosure as said arm support assembly pivots with respect to said rear support member.

12. A collapsible chair in accordance with claim 11 further comprising a front pivotal member pivotally coupling said front portion to said front support member.

13. A collapsible chair in accordance with claim 11 further comprising a coupling member coupling said front support member to a laterally outer side portion of said frame side member.

14. A collapsible chair in accordance with claim 11 further comprising a rear pivotal member pivotally coupling said rear support member and said slide member.

15. A collapsible chair in accordance with claim 11 wherein said rear support member curves laterally outwardly with respect to said frame side member.

16. A collapsible chair in accordance with claim 11 wherein said front support member curves laterally outwardly with respect to said frame side member.

17. A collapsible chair in accordance with claim 11 further comprising an arm rest coupled to said enclosure.

18. A collapsible chair in accordance with claim 11 wherein, with said frame assembly in a collapsed configuration, said arm support assembly is substantially parallel with said rear support member.

19. A collapsible chair in accordance with claim 11 wherein said plurality of frame members are coupled in a plurality of scissor pairs at respective midpoints, and ends of each frame member of said plurality of scissor pairs are joined at pivot assemblies to form said frame assembly, said frame assembly is movable towards a central area to the collapsed configuration and movable away from said central area to the expanded configuration.

20. A collapsible chair comprising:

a frame assembly comprising a plurality of frame members, each frame member of said plurality of frame members including an upper end pivotally attached to a corresponding upper pivot assembly of a plurality of upper pivot assemblies, and a lower end pivotally attached to a corresponding lower pivot assembly of a plurality of lower pivot assemblies, said plurality of frame members coupled in a plurality of scissor frame member pairs to form said frame assembly, said frame assembly movable with respect to a central area between a collapsed configuration and an expanded configuration;

a rear frame member coupled to a rear lower pivot assembly of said lower pivot assemblies and extending through a rear upper pivot assembly of said upper pivot assemblies;

a rear support member coupled to said rear frame member;

a frame side member coupled to said rear lower pivot assembly and a front upper pivot assembly of said upper pivot assemblies;

a front support member coupled to said frame side member; and an arm support assembly pivotally coupled at a front portion to said front support member and pivotally coupled at a rear portion to said rear support member, said rear support member including a slide member positioned within an enclosure defined by said arm support assembly.

21. A collapsible chair in accordance with claim 20 wherein said slide member moves within said enclosure as said arm support assembly pivots with respect to said rear support member.

22. A collapsible chair in accordance with claim 20 wherein, with said frame assembly in the collapsed configuration, said arm support assembly is substantially parallel with said rear support member.

* * * * *